United States Patent [19]

Reece et al.

[11] 4,322,084

[45] Mar. 30, 1982

[54] GOLFER'S STANCE TRAINING DEVICE

[76] Inventors: Carl L. Reece; Gloria J. Reece, both of 1453 State St., Porterville, Calif. 93257

[21] Appl. No.: 184,338

[22] Filed: Sep. 5, 1980

[51] Int. Cl.[3] ..... A63B 69/36

[52] U.S. Cl. ..... 273/187 R; 273/187 B; 273/186 C; 273/192

[58] Field of Search ..... 273/187 R, 187 A, 187 B, 273/191 R, 192, 186 C, 186 R; 434/252

[56] References Cited

U.S. PATENT DOCUMENTS

| | | | |
|---|---|---|---|
| 1,517,555 | 12/1924 | Graham | 273/187 R |
| 2,150,580 | 3/1939 | Crowley | 273/187 R |
| 2,886,326 | 5/1959 | Olds | 273/187 R |
| 3,166,327 | 1/1965 | Champion | 273/187 R |
| 3,868,116 | 2/1975 | Ford et al. | 273/187 R |

*Primary Examiner*—George J. Marlo
*Attorney, Agent, or Firm*—Harvey B. Jacobson

[57] ABSTRACT

A device for properly orienting the feet of a golfer with respect to the golf ball to be struck. Indicators are provided which mount to a longitudinally extending main frame member. One indicator is fixed to the main frame member and extends laterally therefrom at a predetermined angle. The player's left foot is placed against this indicator. A second indicator slides along the frame member and the right foot abuts this indicator. Further indicators are provided for pointing out the location between the player's feet at which the ball is to be placed and the distance that the ball should be placed from the feet. The various indicators can be moved to positions for aligning a broad range of golf shots from drives to putts.

10 Claims, 9 Drawing Figures

GOLFER'S STANCE TRAINING DEVICE

BACKGROUND OF THE INVENTION

1. Field of the Invention

This invention relates to stance devices for positioning a golfer in proper relation to a golf ball for aligning a golf shot.

2. Discussion of Related Art

It has been suggested that success in hitting specific golf shots accurately or playing the ball to a certain position in a certain manner comprises a procedure which is 50% mental, 40% proper set up for the golf stroke, and 10% swing execution. If a golfer sets up exactly right in relation to the shot that he has pictured mentally, the probability of successfully completing that shot is greatly enhanced. On the other hand, if a golfer does not set up the shot correctly, he has very little chance of executing the shot as planned. Accordingly, it can be understood that setting up for the shot is a vitally important aspect of the game of golf. The set up is also the only aspect of the golf stroke over which the golfer has 100% conscious control.

Various devices have been suggested for instructing a golfer in assuming and maintaining a proper stance during the golf stroke. For instance, U.S. Pat. No. 1,208,995, issued Dec. 19, 1916, to Lyon, shows a stance instructor comprising a substantially V-shaped frame including a stationary limb and a relatively movable limb. An arcuate shaped member is fixed on the stationary limb and an arrow is pivoted thereon. Connections exist between the arrow, the arcuate shaped member and the movable limbs whereby adjustment the latter is controlled by the adjustment of the arrow. U.S. Pat. No. 1,517,555, issued Dec. 2, 1924, to Graham, shows a stance indicator comprising a stem having a linear measurement indicated thereon with graduations commencing at one end of the stem and serving as a guide for the user in assuming a position the required distance from the end of the stem. A cross head is secured to that end of the stem at right angles thereto and provided with measurement marks as a guide in locating a ball relative to the cross head and steam. An arm paralleling the cross head is slidably connected to the stem for adjustment laterally toward and from the cross head for positioning a foot of the user at the desired distance from the stem. U.S. Pat. No. 3,658,344, issued Apr. 25, 1972, to Kimble, shows a golfer's stance aid comprising a linear member adapted to rest on the ground, having foot pads adjustable angularly as well as lengthwise of the linear member. Spikes anchor the foot pads in the ground. An extensible member extends laterally outwardly from the linear member to the golf ball. The extensible member has an arm pivoted at its inner end to the midpoint of the linear member, and also has an elongated bar formed by a single strand or wire having coextensive elements shaped to provide a series of openings along its length. These openings are adapted to receive a fastener in the outer end of the arm so that the strand or wire can be connected to the arm through any one of the openings and thereby vary the length of the extensible member. U.S. Pat. No. 3,868,116, issued Feb. 25, 1975, to Ford et al., shows a golf practice device having a longitudinally extending guide portion and an inwardly turned end portion, with one of the end portions fitting over the other in a telescopic relationship. Fasteners are associated with the end portions for adjustably connecting the end portions to vary the width between said longitudinally extending guide portions. Feet or stance guide members are detachably secured to either of the longitudinally extending guide members.

SUMMARY OF THE INVENTION

One object of the present invention is to provide a golf target trainer in the form of a golf stance machine which can be used to train golf students to correctly set up to every conceivable type of golf shot.

A further object of the present invention is to provide a golf stance machine which can be adjusted to fit every length and type of golf club, including the putter. The machine can also be adjusted to fit the height and size of any golfer.

As even still further object of the present invention is to provide a golf stance machine which can be used with equal ease by both right and left handed golfers by simply assembling the machine in one of two possible orientations.

In accordance with the above objects the golf stance machine of the present invention includes an elongated linear frame member which mounts a pair of feet stance indicator bars. One of the bars is fixedly attached to the main frame member and extends obliquely therefrom. The inside of the golfer's forwardmost foot is pressed against this bar. The second feet stance bar is slidably connected to the main frame member for movement therealong. Between the feet stance indicator bars, there is slidably attached to the main frame member a ball distance indicator attachment comprising a telescoping pair of bars for indicating to the golfer the position at which the ball should be placed between the golfer's feet. At each end of the main frame member there is attached a graduated bar which slides perpendicular to the frame member. The outer end of each graduated bar includes a baLL locator bar which slides perpendicular thereto. The graduated bars are used to indicate the distance the ball should be placed away from the golfer's feet while the perpendicular sliding bars point the direction of travel the ball is to take on its course to the particular hole. These elements can be oriented in various ways to set up any golf shot.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
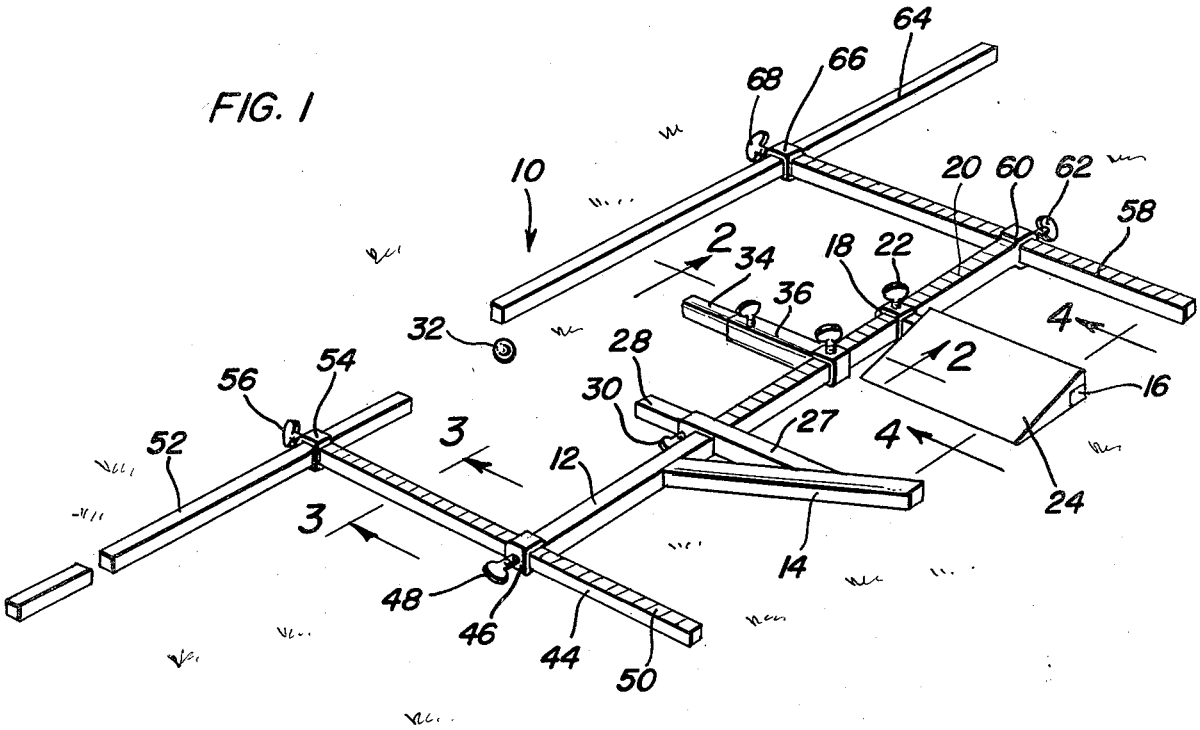
FIG. 1 is a perspective view of the golf stance machine of the instant invention.
Figure 2:
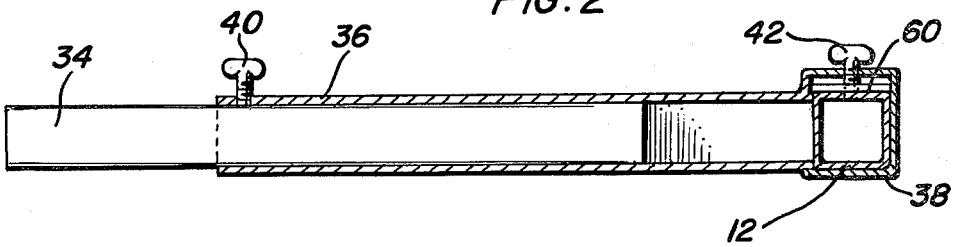
FIG. 2 is an elevational sectional view taken substantially along a plane passing through section line 2—2 of FIG. 1.
Figure 3:
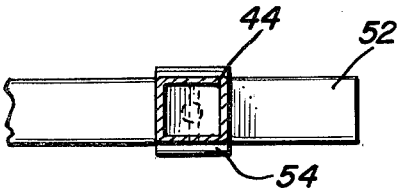
FIG. 3 is an elevational sectional view taken substantially along a plane passing through section line 3—3 of FIG. 1.

Now with reference to the drawings, a golf target trainer comprising a golf stance machine incorporating the principles and concepts of the present invention and generally referred to by the reference numeral 10 will be described in detail.

Figure 4:
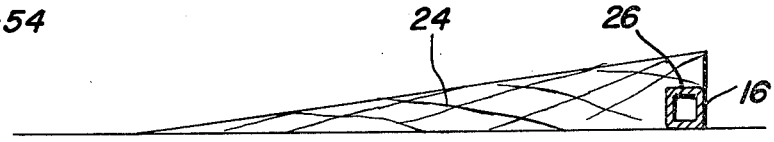
FIG. 4 is an elevational view taken substantially along a plane passing through section line 4—4 of FIG. 1.
Figure 9:
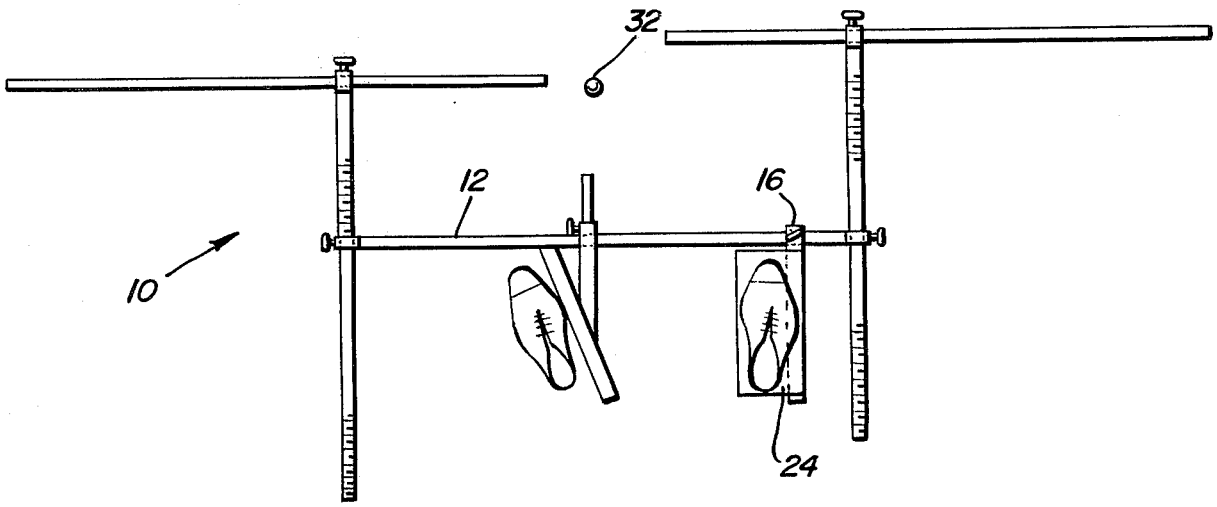
FIG. 9 is a plan view of the golf stance machine set up for use with the anti-sway wedge.

With particular reference to FIGS. 1 through 4, the golf stance machine 10 will be seen to include a main elongated linear frame element in the form of tubular bar 12 which mounts the various components of the machine. A first foot stance indicator bar 14 is fixedly attached to bar 12 and extends obliquely from the bar for indicating the appropriate position for the golfer's forward foot. Bar 14 is also a rectangular tubular member. A second foot stance indicator 16 is attached to a rectangular sleeve 18 which slides longitudinally of the bar 12. Graduations generally shown at 20 extend along bar 12 to indicate the distance or separation between the foot stance indicators 14 and 16. A thumbscrew 22 can be tightened to secure bar 16 in place. Assuming the golfer to be right handed, the inside of the golfer's left foot would be disposed against foot stance indicator 14 with the tip of the left foot being placed directly against bar 12. The outside of the golfer's right foot would be placed against the bar 16. In order to prevent the golfer from shifting the body weight to the outside of the right foot during the back swing and to prevent the right knee from straightening up during the back swing, a wedge 24 can be laid on bar 16 as shown in FIGS. 1, 4 and 9. Wedge 24 has a rectangular recess 26 formed in the bottom thereof in order to fit snugly on bar 16 and prevent sideways movement of the wedge due to the golfer's weight disposed thereon. The golfer merely puts his right foot on the wedge instead of placing the outside of the right foot against bar 16. Wedge 24 is preferably made from hardwood and is small enough to store easily in a golf bag.

A brace 27 also comprises a hollow tube and is fixedly mounted to foot stance indicator bar 14 and bar 12. Brace 27 receives telescopically therein a ball location indicator bar 28 which is held in position by a thumbscrew 30. Indicator bar 28 is used to align the golf ball 32 with the heel of the golfer's left foot. If the ball is to be placed between the left and right feet of the golfer, a second indicator bar 34 is used. Bar 34 is received in a tubular member 36 which is slidably mounted to frame member 12 by sleeve 38 attached about the frame. Thumbscrews 40 and 42 secure the indicator to the tubular member 36 and the sleeve 38 to frame member 12, respectively. Accordingly, it can be seen that the ball 32 is to be positioned between the feet of the golfer, sleeve 38 is simply located at the appropriate position between the golfer's feet with scale 20 providing an accurate measure. In this manner, the same ball position can be accurately reproduced each time a similar shot is to be taken.

At the front end of the frame member 12, a sliding tubular bar 44 is mounted in sleeve 46 and held in place by thumbscrew 48. Bar 44 extends perpendicular to bar 12 and serves to measure the distance that ball 32 is placed from the golfer's feet. Bar 44 contains graduated markings 50 to serve as a visual indicator for setting bar 44. An alignment element 52 is slidably received in the sleeve 54 through which a thumbscrew 56 extends. Element 52 serves two purposes. First, it serves to locate more accurately the exact position which the golf ball 32 is to be placed away from the golfer's feet. Second, by sighting along element 52, the golfer can be made aware of the exact target line along which the shot is to be taken. Element 52 can be adjusted toward the ball as close as the golfer chooses, but most golfers will not want that element closer than about 12".

On the opposite end of the main frame element 12, there is mounted an additional graduated bar 58 which extends perpendicularly to the element 12 through sleeve 60 and is held in place by thumbscrew 62. A second alignment element 64 slides through sleeve 66 and is held in place by thumbscrew 68. Alignment element 64 can be aligned with element 52 by proper adjustment of bar 58. This position will enable the golfer to see and identify the correct target line on the back swing. Accordingly, element 52 gives the forward swing line while element 64 gives the correct back swing line. Alternatively, element 64 can be moved approximately 2" further from the golfer's feet by adjustment of bar 58. This disposition is shown in FIG. 1. Element 64 can then be extended up to and past the golf ball and defines the outside line of the back swing. The fundamentally correct back swing will start and move along element 64 in a straight line for the first 6" to 12". After the golf stroke has been taken, the golfer can look at the divot in relation to element 64 and get additional feedback on what actually happens during the swing.

Figure 5:
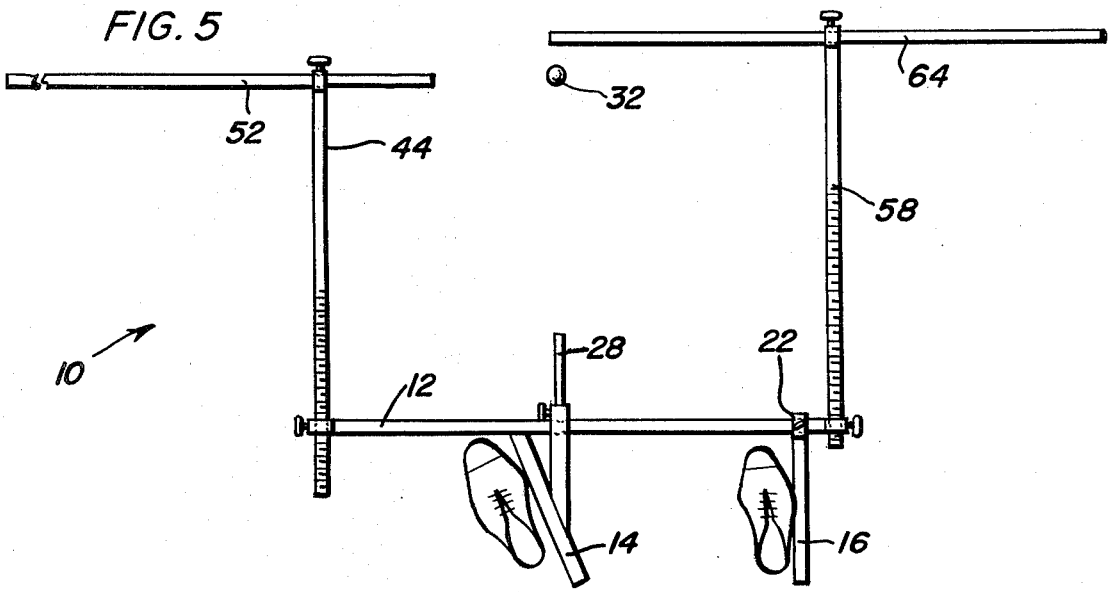
FIG. 5 is a view showing the golf stance machine set up for execution of a drive and all full shots.

FIG. 5 shows the set up for the drive and all full shots. In FIG. 5, it can be seen that ball location indicator 28 is used to align the ball 32 with the inside of the left heel of the golfer. The golfer will set his feet into position by placing the inside of the left foot against element 14 and the tip of his left foot about 1" back from element 12. The outside of the right foot should be placed against element 16 with the tip of the right foot 1" from element 12. The toes of both feet should be set back approximately 1" from the frame member 12 so that the golfer can move his feet normally during a golf swing. Foot stance indicator element 16 should be adjusted to the proper width of the golfer's stance. Element 16 will adjust to any width that is necessary for different club lengths and for varied physical makeup of the golfer. The adjustment is effected by loosening the thumbscrew 22 and sliding the element to the desired position. The markings on element 12 are in inches so that the golfer can learn how far to set his feet apart for each club by looking at these inch markings. The position of alignment elements 52 and 64 should be set according to the discussion had hereinabove.

Figure 6:
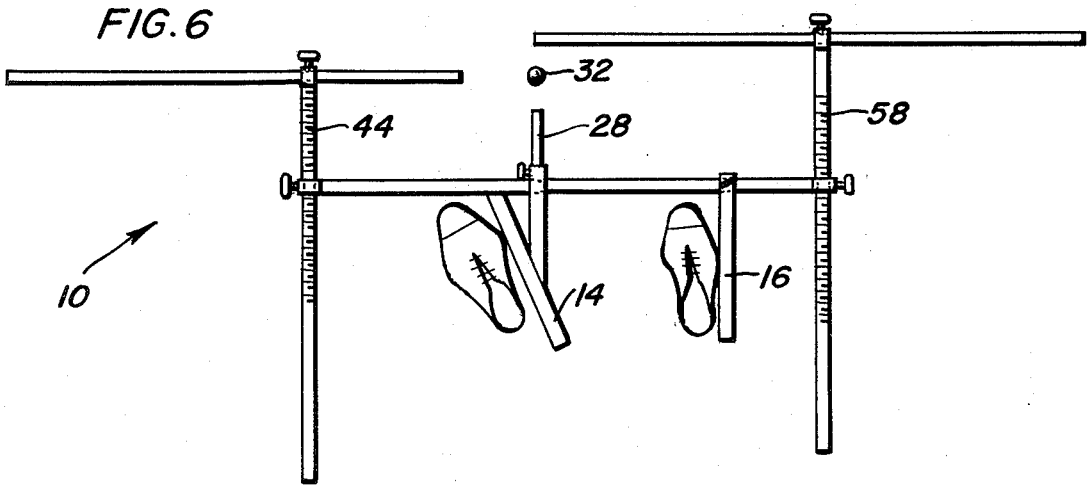
FIG. 6 is a plan view showing a golf stance machine set up for executing chips and pitch shots with a normal trajectory.

FIG. 6 shows the set up for chip and pitch shots using a normal trajectory. The set up in FIG. 6 is similar to that in FIG. 5 except that element 16 is moved slightly closer to element 14 so that the golfer's feet are slightly closer together. Further, elements 44 and 52 are moved in toward the golfer's feet to compensate for the shorter length of the golf club. Again, the ball 32 is aligned with the heel of the golfer's left foot by placing the ball in alignment with element 28.

Figure 7:
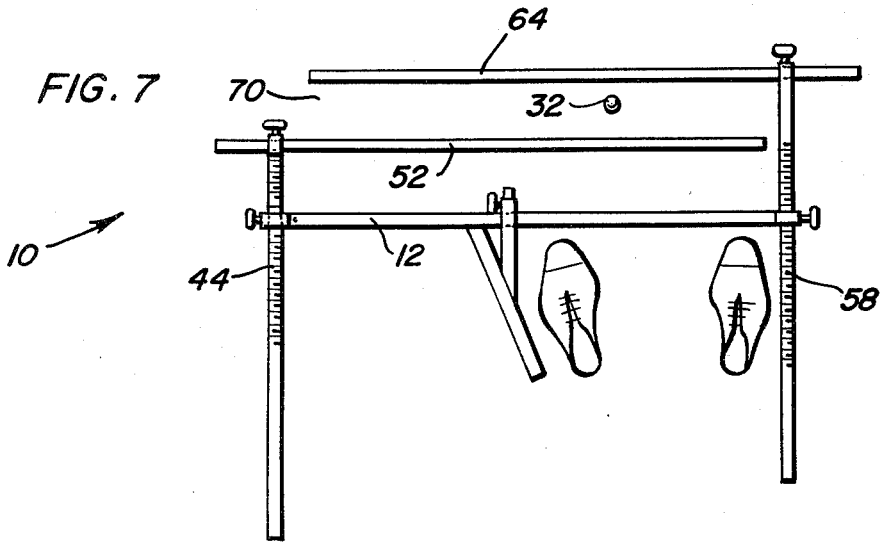
FIG. 7 is a plan view showing the golf stance machine set up for executing putts.

FIG. 7 shows a set up of the golf stance machine for use in putting. In the set up of FIG. 7, elements 16, 34 and 36 should be removed so that the alignment element 52 can be placed in close proximity to the golfer's feet.

Element 52 is then set approximately 2" inside the eye line of the golfer. Element 64 should be set approximately 2" outside of the eye line of the golfer. Element 64 should be extended up to element 44 and element 52 should be extended to element 58. The golfer should set his feet toward the right end of element 12 with the toes of both feet against element 12. To execute a putt, the golfer should place the ball 32 between elements 52 and 64 and take the putter straight back in the channels formed between the elements 52 and 64. The golfer should also keep the putter going straight forward along that channel after he has actually hit the putt. The middle of the opening formed by the ends of elements 52 and 64 visually provide a perfect intermediate target. If the golfer can roll the ball straight through the middle of this opening labelled 70, the ball should continue to roll straight for the target.

Figure 8:
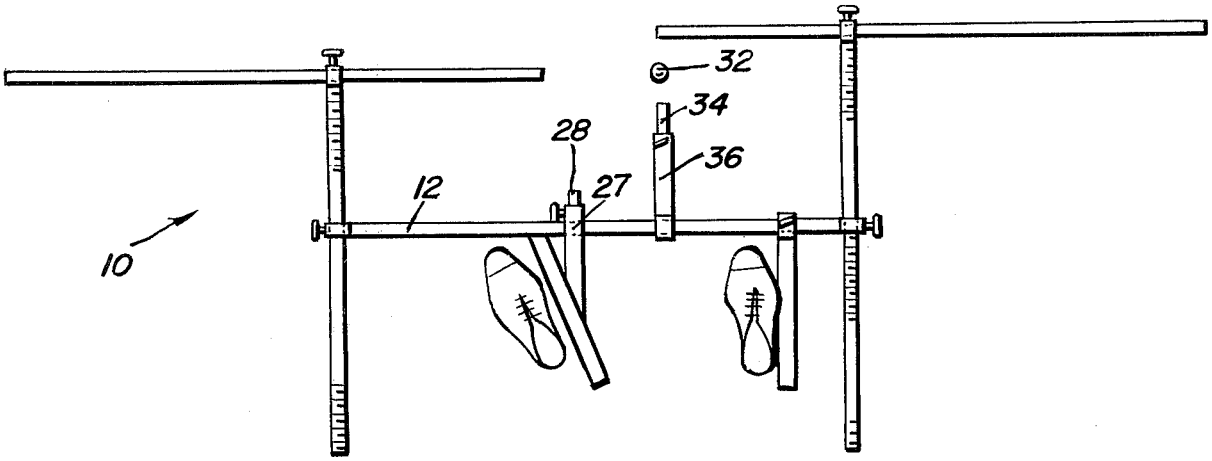
FIG. 8 is a plan view of the golf stance machine set up for a golf shot having a lower than normal trajectory.

FIG. 8 shows the golf stance machine set for a typical shot having a lower than normal trajectory. In such circumstances, the machine 10 is set for the shot using standard set up procedures. Ball location indicator 28 is slid into brace 27 and elements 34 and 36 are placed on the frame member 12. Using the inch markings on member 12, the second ball position indicator comprising elements 34 and 36 is slid between the golfer's feet to the desired location. The further to the right indicator 34, 36 is positioned, the lower the flight trajectory will be. Element 34 is extended out from element 36 to provide an accurate indicator to position the golf ball 32. This procedure can be used for any golf club.

FIG. 9 shows the use of wedge 24 with the golf stance machine. As discussed above, wedge 24 is placed on foot stance indicator 16 in order that the right foot of the golf will be slightly inward. Wedge 24 can help train the golfer to keep the weight on the inside of the right foot throughout the back swaying or to stop swing. Wedge 24 will also help train the golfer to keep his right knee flexed throughout the back swing. These results can be accomplished by the golfer placing his right foot completely on wedge 24 initially. As the golfer improves, he can place less of his foot on the wedge and place more of his foot on the ground, until his entire right foot is almost completely on the ground.

It should also noted that by loosening all of the thumbscrews, the elements of the golf stance machine 10 can be completely disassembled and carried easily in a golf bag. When assembling, the machine 10 can be put together for use either by right handed or left handed golfers by merely properly orienting main frame member 12.

The foregoing is cosidered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device for use as an instructional aid in golf, comprising:

an elongated central body member;

a first foot stance position indicator comprising a bar attached to said body member and extending laterally therefrom;

a second foot stance indicator comprising a second bar slidably connected to said body member and extending laterally therefrom;

a first ball position indicator slidably attached to said body member and extending laterally therefrom in a direction opposite to that of said feet position indicator bars; and a first alignment indicator attached at one end of said body member and including a first alignment member extending perpendicular to said body member and a second alignment member attached to said first alignment member and extending parallel to said body member.

2. The invention as defined in claim 1 and further including a second alignment indicator attached to the opposite end of said body member from said first alignment indicator, said second alignment indicator comprising a third alignment member extending perpendicular to said body member and a fourth alignment member extending parallel to said body member.

3. The invention as defined in claim 2 wherein said first alignment member and said third alignment member each comprises a bar having graduated markings thereon with a sleeve disposed at one end for receiving the second and fourth alignment members respectively.

4. The invention as defined in claim 1 and further including a second ball location indicator fixedly attached to said body member.

5. The invention as defined in claim 4 wherein one of said foot stance indicators is disposed at an oblique angle to said body member.

6. A golf stance training device, comprising:

a body member in the form of an elongated bar;

a first foot indicator means including an elongated bar attached to said body member at an oblique angle thereto;

a second foot indicator means comprising an elongated bar slidably disposed on said body member perpendicular thereto;

a first ball location indicator affixedly attached to said body member and including an adjustable pointer extending therefrom; and a second ball location indicator slidably attached to said body member and including a second pointer extensible therefrom.

7. The invention as defined in claim 6 and further including a first alignment indicator means attached to one end of said body member and including a first bar extending perpendicular to said body member and slidably attached to said body member, a second bar slidably attached to said first bar perpendicular thereto.

8. The invention as defined in claim 7 wherein said first bar of said first alignment indicator means includes graduated markings thereon.

9. The invention as defined in claim 8 and further including a second alignment indicator means including a third bar member slidably attached to the opposite end of said body member and a fourth bar member slidably attached to one end of said first bar of said second alignment indicator means.

10. The invention as defined in claim 9 wherein said second foot indicator means includes a wedge attachment having a sloped upper surface, said attachment being adapted to rest upon said elongated bar of said second foot indicator means for canting one of a golfer's feet.

* * * * *